United States Patent [19]

McCullough et al.

[11] Patent Number: 4,756,941

[45] Date of Patent: Jul. 12, 1988

[54] METHOD AND MATERIALS FOR MANUFACTURE OF ANTI-STATIC CARPET AND BACKING

[75] Inventors: Francis P. McCullough, Lake Jackson, Tex.; David M. Hall, Auburn, Ala.

[73] Assignee: The Dow Chemical Company, Midland, Mich.

[21] Appl. No.: 3,973

[22] Filed: Jan. 16, 1987

[51] Int. Cl.[4] ..... B32B 3/02

[52] U.S. Cl. ..... 428/95; 428/97; 428/222; 428/367; 428/371; 428/408

[58] Field of Search ..... 428/95, 97, 222, 408, 428/367, 371

[56] References Cited

U.S. PATENT DOCUMENTS 4,643,931 2/1987 McCullough et al. ..... 428/97

*Primary Examiner*—Marion C. McCamish

[57] ABSTRACT

There is described an electroconductive tow or yarn, made from continuous filaments or staple fibers yarns, prepared from stabilized petroleum pitch, coal tar pitch or a synthetic fiber forming material which on at least partial carbonization is electroconductive, for example, polyacrylonitrile, are formed into coil-like fibers or filaments by winding the tow or yarn on a mandrel, but preferably by knitting the tow or yarn into a cloth, and heat treating the so formed tow or yarn to a carbonizing temperature (450° C. to about 1500° C.) to set a coilure (a non-textile crimp) therein as well as electroconductance thereto, and incorporating the coilure structure into scrim yarns, scrim capcoats, composites with tuftlock components as well as incorporation into the carpet yarns, to provide an anti-static property to the finished carpet.

8 Claims, No Drawings

METHOD AND MATERIALS FOR MANUFACTURE OF ANTI-STATIC CARPET AND BACKING

BACKGROUND OF THE INVENTION

Carpeting is manufactured from yarns or tows produced from natural or synthetic staple fibers or continuous synthetic filaments, respectively. The fibers are delivered to a yarn spinning plant in bales while the filament is shipped on cones. The yarn maker generally blends all of the staple fiber of a particular lot (generally 10 to 50 bales), through an opening process which consist of mixing portions of each bale in the lot in one or more opening operations (a process by which the compressed bale fibers are separated and by taking fibers from several bales at a time the fibers of the entire lot are blended, thus insuring a greater uniformity among the fibers, by carding as a first operation which tends to draw the fibers parallel and form long ropes of the fiber called card-slivers which are several inches in diameter). The output of these operations, the redistribution of the many fibers in the lot into a card-sliver, insures more uniform yarn properties, such as dye acceptance. In some instances the fibers are blended twice, or cross blended as this practice is referred to in the trade. Depending upon the ultimate use of the yarn, various treatments may be undertaken during blending, such as tinting for lot identification and/or application of lubricants and the like. The blended fibers in this rope-like card sliver are fed to pin drafters, an operation tending to further parallel the individual fibers and draw down the diameter of the resulting sliver. It is customary for the sliver to be pin-drafted several times so that the yarn (referred to as a singles) subsequently produced will be of the desired weight and, of course, obtain uniformity through further combining and paralleling of the fibers.

A yarn, or more properly a tow, may also consist of an assembly of any number of continuous mono-filaments drawn from several cones which are combined and twisted to give a continuous multi-filament tow singles.

Normally these singles yarns, from both staple and continuous filaments, are plied, two ply being the most common, by twisting the singles in a reverse direction to the singles twist, a process referred to as cabling.

In most modern day carpet mills the yarns or tows are "tufted" or punched through a scrim or primary backing made from jute, polypropylene or other woven or non-woven mmaterial on machines which may be and usually are computerized to enable numerous designs both as to length of the loop, type of loop, number of loops per inch, etc. to be made. This assembly can be, and usually is, dyed in one of the numerous batch or continuous dye machines commonly in use today. The so tufted carpet may have the loops cut, if a cut loop pile is desired, and an adhesive, such as latex, urethane or the like, applied and cured onto the back of the carpet to anchor the tufts to the primary backing. The carpet is usually trimmed to the desired width either at this point or before the latex is applied. To provide stability and weight to the carpet, a secondary backing of jute, polypropylene, or the like, may be attached to the back side of the carpet.

At the present time in order to produce reliable antistatic carpets for the most demanding uses, the electronics industry, it has become common practice for the carpet manufacturer to incorporate a metallic grid into the primary backing system. Such a technique is expensive and creates several problems for the manufacturer. The manufacturer must handle a heavy scrim which is less flexible than the ordinary scrim, and, because of the metallic grid, creates problems with the standard machinery used for tufting and handling carpet for dyeing, etc.

When the end use of the carpet is not to be placed under the severe criteria of the electronics industry, the mills have begun to blend or have blended into the staple fibers from which the yarn is spun a small amount of a conductive fiber to act as a static dissipation element. Such fibers are composites made conductive by incorporating into a hollow fiber a core of carbon (graphite) or by coating a fiber with a sheath made of a composite containing carbon (graphite), among the more common methods. These electroconductive fibers may be blended with the polymer fibers at the staple cutting stage. However, in many instances these composite fibers after, being made into staples, are added to the synthetic staple fibers at the opening stage. In most instances while electrostatic charges are dissipated to some degree when either of the afore described electroconductive fiber (sheath coated or hollow fiber filled with carbon (graphite) composites are employed only modest results are achieved.

It would therefore be advantageous for the consumer to have a more effective antistatic carpet. It would also be advantageous from the carpet manufacturers position to have a better conductor and a more readily incorporatable technique for placing the conductive fiber (carbon or graphite) into the existing carpet process to obtain a more uniform distribution and greater assurance that the contact with a substantial number of tufts, loop or pile of the carpet assembly are made to carry the static charge away from the source, i.e., distribute the charge over a large area of the carpet. In addition it would be advantageous for the manufacturer to eliminate the wire in the primary backing and thus eliminate the problems inherent therewith.

BRIEF DESCRIPTION OF THE INVENTION

In accordance with the present invention a primary carpet backing having antistatic discharge properties is prepared by incorporating into the backing or applying to the backing an electroconductive tow or yarn , made from continuous filaments or staple fibers yarns, or thin fluff-like web the individual fibers of the yarn or the filaments of the tow and web having spring-like structure or coil-like configurations capable of reversible deflection of greater than 1.2 times the length of the spring-like structure when in a relaxed condition, prepared from stabilized petroleum pitch, coal tar pitch or a synthetic fiber forming material, such as polyacrylonitrile, which on at least partial carbonization is electroconductive, for example, polyacrylonitrile, and are formed into the coil-like fibers or filaments by winding the stabilized but uncarbonized tow or staple yarn on a mandrel, but preferably by knitting the tow or yarn into a cloth, and heat treating the so formed tow or yarn to a carbonizing temperature (450° C. to about 1000° C.) to set a coilure (a non-textile crimp) therein as well as electroconductance thereto. The carbonaceous material included in the primary backing or scrim weaving process by incorporation into the fibers, yarn or tows or as a separate warp or fill yarn, filament assembly or tape at any one of several steps in the scrim yarn making process or applied to the scrim in one of several convenient manners produce the electrostatic charge dissipating scrim material.

When non-woven scrim material is employed, the carbonaceous material, prepared in the same manner and preferably chopped into approximately seven inch lengths is distributed throughout the non-woven conventional material during some stage in its processing to the ultimate non-woven product.

The preferred point at which the carbonaceous material of the present invention is introduced into backing material is when the backing material is being manufactured using any number of the present commercially employed methods. It is of course to be understood that the carbonaceous material can be added to the backing material at any stage prior to tufting or applied to the backing after tufting as more fully described hereinafter.

It is also to be understood that, a tow or yarn of or containing the carbonaceous filaments may be heat-set in conventional textile crimp stabilizing apparatus, carbonized in accordance with the present invention and either cut into staple or fed as a continuous filament to the continuous filament twisting or cabling stage, combining with the conventional filaments to produce a yarn or tow having static dissipation properties and used in the scrim manufacturing processes as described above or be applied to the backing surfaces. This carbonaceous material, however, has less desirable properties than the non-textile crimp material of the present invention, since it does not have the deflection or spring-like nature imparted to the non-textile crimp coil-like structure of the present invention and thus is more susceptible to being reduced to shorter elements during handling and such degradation of continuity affects the ultimate electrostatic dissipation properties.

In the case of non-woven scrim the carbonaceous material of the present invention may be added during the preparation of the mats as a staple or laid into the mat as long filaments, readily adapting its inclusion to the existing machinery for making such non-woven materials.

In addition the carbonaceous material can be spread onto the scrim or primary backing as neat fiber or blended with other fiber (nylon, polyethylene, etc.) and adhered thereto by taking advantage of the softening characteristics of the conventional synthetic fiber material or backing.

The knit fabric is preferably deknitted the resulting yarn or tow having a coilure configuration, chopped into appropriate length for blending with the standard scrim staple, made into yarns and woven into scrim. Similarly, continuous filaments, treated in the same manner to form the coilure structure, as by knitting into a cloth, are retrieved from the cloth by deknitting and introduced into the tows of continuous filaments of polypropylene, for example , used to make scrim from such tows.

The tows or yarns retrieved from the deknitting of the cloth or removal from the mandrel may be carded to produce fluff-like materials which can be applied to the scrim during the tufting process or secured to the scrim after tufting. The fluff may also be chopped and added to chopped staple used in preparing non-woven materials used to form the primary backings. In accordance with the present invention and as a means to further improve the static dissipation properties of the finished carpet, the anti-static carbonaceous material may also be added, and preferably is added to the yarns used in manufacturing the carpet, as fully described in our co-pending application, Ser. No. 773,961, filed Sep. 11, 1985, entitled Method and Materials for Manufacture of Antistatic Carpet, now U.S. Pat. No. 4,463,931, issued Feb. 17, 1987, incorporated in toto herein. This is accomplished by incorporating an electro- conductive tow or yarn, made from continuous filaments or staple fibers, respectively, prepared from stabilized petroleum pitch, coal tar pitch or polyacrylonitrile, preferably as a knit, heat-treated to a carbonizing temperature and thereafter deknitted, chopped into appropriate length and blended with the standard carpet fibers or yarn at any one of several steps in the yarn making process to produce a yarn having static dissipation properties.

The preferred point at which the carbonaceous material is introduced into textile carpet staple yarn making processes is at the blenders because there will be obtained a more uniform blending and distribution throughout the ultimate yarn. It is of course to be understood that the carbonaceous material can be added in sliver form at the pin drafters or as a staple fiber at the opening cards, or as a continuous yarn tow during twisting or cabling.

It is to be understood that a tow or yarn of the carbonaceous filaments can be heat-set in conventional textile crimp stabilizing apparatus, carbonized and either cut into staple and mixed with the conventional staple fiber during spinning or fed as a continuous filament to the continuous filament twisting or cabling stages, combining with the conventional filaments to produce a textile yarn or tow having static dissipation properties, but of poorer performance characteristics than the carbonaceous material prepared in accordance with the preferred concepts of the present invention.

The carbonaceous material useful in accordance with the present invention is more fully described in U.S. patent application Ser. No. 558,239, entitled Energy Storage Device, filed Dec. 5, 1983, and Ser. No. 678,186, entitled Secondary Electrical Energy Storage Device and Electrode Therefore, filed Dec. 4, 1984, each by Francis P. McCullough and Alvin F. Beale, which is incorporated in toto herein, which when modified in accordance with U.S. patent application Ser. No. 722,440 and its continuation-in-part Ser. No. 827,567, each entitled Novel Fabric and Fiber, filed April 18, 1985 and Feb. 10, 1986, respectively, the latter being a continuation-in-part of the earlier filed application by Francis P. McCullough and David M. Hall and U.S patent application Ser. No. 856,305, filed April 16, 1986, by said McCullough and Hall entitled Carbonaceous Fibers with Spring-like Reversible Deflection and Method of Manufacture which is a continuation-in-part of Ser. No. 827,567 serves as a preferred embodiment of the carbonaceous material suitable for use in accordance with the present invention.

DETAILED DESCRIPTION OF THE INVENTION

In accordance with one embodiment of the present invention the fibers from bales of an undyed lot of polypropylene, although other fiber material such as nylon or other synthetic fiber or natural fibrous material commonly used as backing materials, the fibers of which are approximately seven inches long, are introduced into the opening (blending) process by alternately feeding to several blenders a small portion of the fibers from each bale along with a small amount of the fibers of the carbonaceous material (preferably derived from knitting, carbonizing, deknitting and cutting to similar staple length (about 7") a stabilized filament prepared from a petroleum pitch, coal-tar pitch or polyacrylonitrile spun filament). The ratio of synthetic fibers to carbonaceous material is generally greater than about 100 to 200 times the amount of undyed fibers from the lot to the carbonaceous staple coilure non-textile crimped material, on a weight basis. The resulting fibrous card slivers are generally rebaled and thereafter blended again feeding a small amount from each bale almost simultaneously to the blenders. At this point the slivers can be introduced into the yarn spinning process or into the non-woven scrim process. In the yarn spinning processes following opening or blending, the fibers are carded. The output of several cards are fed to conventional pin drafting and spinning operations and usually two of these yarns are ply twisted together in a reverse direction to the single's yarn twist to form a two ply yarn. Such yarns are subsequently woven into a scrim material by conventional weaving machines.

A scrim or backing can also be produced from continuous filament yarns or tapes, split film, fibrilated films or the like. When such materials are used the carbonaceous fibers of the present invention may be present as an element of the tow or as a separate tow or yarn introduced into the weaving process as one does a pattern in any woven goods. Thus, the carbonaceous material, as a tow of a few filaments or single filaments can be introduced into the twisting and cabling step for continuous filament yarns or merely fed with the tape to the weaving process or introduced as a separate yarn once every 4 to 20 rows.

It is to be understood that not every yarn has to have associated with it a carbonaceous fiber or filament, but it is advantageous to have such distribution.

The present invention is especially useful when the carpet yarns also contain the carbonaceous material and they are used in combination with a primary backing or scrim which also contain the carbonaceous material.

In addition to the other techniques employed as above described, the carbonaceous material, either crimped or not, can be incorporated into the scrim, woven or non-woven, by spreading the fibers or filament either neat or as a blend with other fibers, onto the scrim surface and subjecting the scrim to a heating process, whereby the scrim material is softened and the carbonaceous material is thus adhered loosely onto the scrim backing surface.

In accordance with the preferred embodiment of the present invention a carpet is prepared from yarns, the fibers of which are derived in part from bales of undyed nylon or other suitable synthetic fiber combined with the carbonaceous fibers above described. Thus, staple fibers, which are approximately seven inches long, are introduced into the opening (blending) process by alternately feeding to several blenders a small portion of the fibers from each bale along with a small amount of the fibers of the carbonaceous material (the latter preferably derived from knitting, carbonizing, deknitting and cutting to staple length (about 7") a stabilized filament prepared from a petroleum pitch, coal-tar pitch or polyacrylonitrile or similar spun filament). The ratio of synthetic fibers to carbonaceous material is generally greater than about 100 to 200 times the amount of undyed fibers from the lot to the carbonaceous staple crimped material, on a weight basis. The resulting fibrous mats or card slivers are rebaled and thereafter blended again feeding a small amount from each bale almost simultaneously to the blenders. Following opening or blending, the fibers are carded then pin drafted. The output of several pin drafters are fed to a conventional spinning operations and usually two of these yarns are ply twisted together in a reverse direction to the single's yarn twist to form a two ply yarn. Such two ply yarns are subsequently tufted into a primary backing or scrim in the carpet manufacturing process, again preferably, having the carbonaceous material incorporated into it in any of the preceding manners. This product is dyed, trimmed and backed.

In a representative operation the carbonized, deknitted, staple length cut carbonaceous fiber was blended with several bales from a lot of staple fiber and the resulting blanket carded and pin drafted. This sliver was combined, at the appropriate pin drafters (first, second or third) depending on the ratio of carbonaceous fiber to synthetic fiber desired, e.g. with 100 to 200 times its weight of additional slivers containing no carbonaceous material prepared as afore described, at the pin drafters. There is thus obtained a sliver which has the carbonaceous fibers distributed throughout but introduced at a different point in the staple yarn making (spinning) process.

Conventional Carpet Backing

Carpet backings are most preferably manufactured from polypropylene yarns, tapes films, split films etc such as those produced by Amoco fabrics Co. and Wayntex or spun bonded products such as those produced by Typar. The accepted standard for the industry for woven backing is a 24×11 construction using warp yarn in the 450–500 denier range and fill yarns 1100–1200 denier; however, other combinations are possible. Generally the woven polypropylene substrates are needle punched with a light weight fiber web (usually Nylon as practiced by the Ozite Corp. see Ozite Corp patent) so as to provide a dyeable surface to match the coloration of the face yarn. This is typically known in the trade under such trade names as "Angle Hair", "FLW", or "FUZZ-BAC" and referred to generically as capcoating. This capcoated product is presently available from most backing producers in a variety of fiber weight and fabric combinations and comprised 30–35% of all polypropylene capcoated primary backing in 1979. As stated the primary purpose of the capcoat is to prevent "grin-through" when low density face pile (less than 28 oz/yd$^2$) is used.

Examples of Invention

EXAMPLE 1

About 1 oz of the conductive fiber is blended with an equal amount of the Nylon fiber web. About 3–4 oz of this web is needle punched per yard onto the polypropylene primary backing to give a conductive carpet. Static discharge tests conducted on this material showed the material to be conductive, the 5000 volt static charge being dissipated in less than 1/10th second.

EXAMPLE 2

A web of conductive fibers with no filler fiber is needle punched at a rate of 1–2 oz. per yard onto the face of the polypropylene primary backing to give a conductive backing. In like manner the conductive fibers were needle punched into the following backings: Fiberglass backing, a spun bonded backing product (Typar), and a woven jute backing. Each backing was subjected to the static dissipation test and each performed in a similar manner, discharged to zero in less than 1/10th second.

EXAMPLE 3

A web containing 1-2 oz of conductive fiber is glued per yard to the face of several polypropylene primary backing using 1. A latex adhesive followed by curing to harden the latex.
2. A hot melt adhesive.
3. A rubber based adhesive
4. A latex containing conductive carbon as in number 1.

Static discharge tests on each backing gave similar results as the foregoing Examples, zero discharge in less than 1/10th second.

EXAMPLE 4

Continuous filament webs instead of staple fiber webs are anchored to the primary backing face using 1. Needle punch
2. Adhesive (followed by curing when appropriate)
   a. Latex
   b. Hot melt adhesive
   c. Rubber cement.

Each of the above backings was tested for its ability to discharge a static charge and found to dissipate the charge in less than 1/10th second.

EXAMPLE 5

Monsanto 1879 nylon (trilobal) fiber was blended with 0.5% by weight of a conductive fiber which had been prepared by heating an oxidatively stabilized polyacrylonitrile multi-filament tow which had been knitted into a fabric, heat-set at about 750° C., de-knitted and cut into staple approximately 7 inches in length. The blended fibers were carded and the resulting sliver was pin drafted three times-recombination ratios were 10:1, 3:1, and 5:1, respectively. The resulting drafted sliver was spun into a single ply yarn with an average twist of about 4.75 and the single yarn was plied with a nylon yarn made in the same fashion but containing no carbonaceous fiber. The 3.00/2 ply yarn which was heat set on a Suessen heat setting apparatus was thereafter tufted into a ⅛ gauge, 47 oz.,⅝ in. pile height carpet (a cut loop form) with approximately 8 stitches per inch. The resulting carpet was tested for static discharge properties by charging the carpet to 5000 volts while in an atmosphere having a relative humidity of less than 20%. The static charge was dissipated to 0% of original charge in less than one second, and some of the samples discharged in less than 1/10 second. The standard for the industry is a discharge to 0% in 2 seconds or less.

Thus it has been found that sufficient static dissipation properties are obtained if the material of the present invention is incorporated into yarns or tows used in the scrim manufacturing process or in the carpet yarn manufacturing process, particularly when the two aspects are combined and such yarns used as the 3rd, 4th, 5th or even every 6th warp or fill yarn.

What is claimed is:

1. An anti-static primary backing for a carpet which comprises a multiplicity of non-linear carbonaceous fibers or filaments applied to the back side of a carpet or incorporated into a conventional backing scrim or tuft lock coat, said non-linear fiber or a filament being derived from a stabilized polyacrylonitrile or petroleum or coal tar spun fiber or filament, which has been formed into a non-linear coil-like configuration having a reversible deflection ratio greater than 1.2 times the length of the coil-like configuration in the relaxed condition, and has been partially or fully carbonized.

2. A primary backing for a carpet having static discharge properties to 0% of original charge in less than about 1 second comprised of:

a scrim, containing from 0.25 to 0.5 weight percent of carbonaceous fibers or filaments derived from a stabilized heat set carbonized polyacrylonitrile or petroleum or coal tar pitch spun fibers, which has a non-linear coil-like configuration having a deflection greater than 1.2 times the length of the coil-like configuration in the relaxed condition obtained by knitting, heat setting, carbonizing and deknitting, said carbonization being conducted at between about 400° C. and about 1000° C., said fibers or filaments being incorporated into the warp or fill yarns of the scrim yarn.

3. A backing for a carpet having static discharge properties to 0% of original charge in less than about 1 second comprised of:

a scrim to which a latex tuft lock is applied, said tuft-lock containing from 0.25 to 0.5 weight percent of carbonaceous fibers or filaments derived from a stabilized heat set carbonized polyacrylonitrile or petroleum or coal tar pitch spun fibers, which has a non-linear coil-like configuration having a deflection greater than 1.2 times the length of the coil-like configuration in the relaxed condition obtained by knitting, heat setting, carbonizing and deknitting, said carbonization being conducted at between about 400° C. and about 1000° C.

4. A carpet primary backing having static discharge properties to 0% of original charge in less than about 1 second which bacfking is comprised of at least from 0.25 to 0.5 weight percent of carbonacfeous fibers or filaments derived from a stabilized heat set carbonized polyacrylonitrile or petroleum or cfoal tar spun fibers, which has been set in a non-linear coilure configuration having a deflection greater than 1.2 times the length of the non-linear coilure configuration in the relaxed condition by knitting, heat setting, carbonizing and deknitting, said carbonization being carried out to between about 450° C. and about 1500° C.

5. A carpet primary backing having static discharge properties to 0% of original charge in less than about 1 second which backing is comprised of at least about 0.25 to 0.5 weight percent of carbonaceous fibers or filaments derived from as stabilized heat set carbonized poly arylonitrile or petroleum or coal tar spun fibers, which has been crimped in the standard heat-set crimp method to a degree such that the fibers have a delfection greater than 1.2 times the length of the crimp set configuration in the relaxed condition, then carbonized and spun into a singles yarn in conventional manner, said carbonization being carried out to between about 450° C. and about 1000° C.

6. A carpet having static discharge properties from 5000 volts to 0% of original charge in less than about 1 second comprised of a primary backing having incorporated therein at least from 0.25 to 0.5 weight percent of carbonaceous fibers or filaments derived from a stabilized heat set carbonized polyacrylonitrile or petroleum or coal tar spun fibers, which has been set in a coilure configuration having a deflection greater than 1.2 times the length of the non-linear coilure configuration in the relaxed condition by knitting, heat setting, carbonizing and deknitting, said carbonization being carried out to between about 450° C. and about 1500° C.

7. A carpet having static discharge properties to 0% of original charge in less than about 1 second comprised of:

a yarn tufted into a scrim, said yarn consisting of at least a single ply of a yarn prepared by pin drafting a sliver containing from 0.25 to 0.5 weight percent of carbonaceous fibers or filaments derived from a stabilized heat set carbonized polyacrylonitrile or petroleum or coal tar spun fibers, which has a non-linear coil-like configuration having a deflection greater than 1.2 times the length of the coil-like configuration in the relaxed condition obtained by knitting, heat setting, carbonizing and deknitting or crimped in the standard heat-set crimp method, carbonizing and spun into a singles yarn in conventional manner, said carbonization being conducted at between about 400° C. and about 1000° C.

8. An anti-static primary backing for a carpet which comprises a conventional backing material in and/or onto which a capcoat comprising an effective amount of heat set non-linear static dissipating carbonaceous fibers or filaments are incorporated, said fibers or filaments having a deflection greater than 1.2 time the length of the non-linear configuration in the relaxed condition.

* * * * *